US005634783A

United States Patent [19]

Beal

[11] Patent Number: 5,634,783

[45] Date of Patent: Jun. 3, 1997

[54] GUIDED-VANE ROTARY APPARATUS WITH IMPROVED VANE-GUIDING MEANS

[76] Inventor: Arnold J. Beal, 11221 Concord Woods Dr., Knoxville, Tenn. 37922

[21] Appl. No.: 541,638

[22] Filed: Oct. 10, 1995

[51] Int. Cl.[6] ..... F04C 2/00

[52] U.S. Cl. ..... 418/264; 418/91; 418/92

[58] Field of Search ..... 418/261, 264, 418/83, 91, 92; 123/243

[56] References Cited

U.S. PATENT DOCUMENTS

| | | | |
|---|---|---|---|
| 3,250,260 | 5/1966 | Heydrich | 418/260 |
| 3,348,494 | 10/1967 | Fischer . | |
| 3,450,108 | 6/1969 | Rich | 418/92 |
| 3,640,648 | 2/1972 | Odawara . | |
| 3,727,589 | 4/1973 | Scott . | |
| 3,863,611 | 2/1975 | Bakos . | |
| 3,904,327 | 9/1975 | Edwards et al. | 418/264 |
| 3,988,083 | 10/1976 | Shimizu et al. . | |
| 4,212,603 | 7/1980 | Buran et al. . | |
| 4,859,163 | 8/1989 | Schuller . | |
| 4,998,868 | 3/1991 | Sakamaki et al. . | |
| 5,030,074 | 7/1991 | Sakamaki et al. . | |
| 5,277,158 | 1/1994 | Pangman . | |

*Primary Examiner*—Charles G. Freay
*Attorney, Agent, or Firm*—Michael E. McKee

[57] ABSTRACT

A guided-vane type rotary apparatus including a housing, a rotor rotatably mounted within the housing for rotation about an axis, and vanes associated with the rotor for movement radially with respect thereto between alternative radial positions utilizes an endless groove defined in the housing and cam follower elements which are joined to the vanes and captured between the walls of the groove. As the rotor is rotated about its axis and the vanes are forced to rotate within the housing in conjunction with the rotor, the cam follower elements are guided along the groove and force the vanes to move radially of the rotor between alternative radial positions. Thus, the walls of the groove and each mechanism joined to a vane cooperate as cam and cam follower, respectively, to move the corresponding vane between alternative radial positions as the rotor is rotated within the housing.

23 Claims, 5 Drawing Sheets

GUIDED-VANE ROTARY APPARATUS WITH IMPROVED VANE-GUIDING MEANS

BACKGROUND OF THE INVENTION

This invention relates generally to guided-vane rotary apparatus and relates, more particularly, to the means by which the vanes of such apparatus are guided along predetermined paths during apparatus operation.

Guided vane-type rotary apparatus with which this invention is concerned include a rotor which rotates within the interior of a housing and vanes which are associated with the rotor and housing for dividing the housing interior into working chambers. Commonly, the vanes are mounted within the rotor and are adapted to slide relative thereto between alternative radial positions as the rotor is rotated within the housing. Heretofore, guided-vane rotary apparatus of the prior art have been limited in that each possesses either a relatively low displacement per revolution, low chamber compression and expansion ratios, low output torque, high sliding friction with undue wear, or difficulties relating to seals which result in mediocre performance. In addition and with regard to such apparatus when used in a rotary vane type heat engine, the designs of the prior art have not shown adequate development in the areas of sealing, lubrication, and the control of temperature uniformity.

It is an object of the present invention to provide a new and improved guided-vane rotary apparatus capable of operating at high levels of performance with improved sealing, reduced friction, reduced wear, and adequate control of component operating temperatures while providing long useful life.

Another object of the present invention is to provide such an apparatus providing a relatively large displacement per revolution.

Still another object of the present invention is to provide such an apparatus capable of greater torque output when the apparatus is used in a manner providing rotational work.

A further object of the present invention is to provide such an apparatus which when used as an internal combustion engine is capable of adequate compression and expansion ratios with adequate combustion space clearances.

A still further object of the present invention is to provide such an apparatus including improved means for coordinating the radial movement of vanes between alternative radial positions as the rotor is rotated about its axis of rotation.

One more object of the present invention is to provide such an apparatus which is uncomplicated in construction and effective in operation.

SUMMARY OF THE INVENTION

This invention resides in a guided-vane type rotary apparatus including housing means including a body defining an opening which provides an interior for the housing means and a rotor including a body mounted within the interior of the housing means for rotation about an axis and defining a slot extending radially of the rotation axis. The body of the housing means further defines a side face adjacent the opening of the interior of the housing means, and the side face defines a groove which encircles the opening. The apparatus also includes a vane positioned within the slot of the rotor body for movement radially thereof between alternative radial positions and means cooperating between the vane and the groove defined in the side face of the body of the housing means for coordinating the radial movement of the vane relative to the rotor with the rotation of the rotor about the axis. The cooperating means includes a camming, i.e. follower, element which is positioned within the groove for movement therealong and is connected to the vane so that as the rotor is rotated about its axis through a complete revolution and the camming element is guided along the groove, the camming element is shifted radially toward and away from the axis of rotation and the vane is moved radially of the rotor by a corresponding amount.

DETAILED DESCRIPTION OF THE ILLUSTRATED EMBODIMENT

Figure 1:
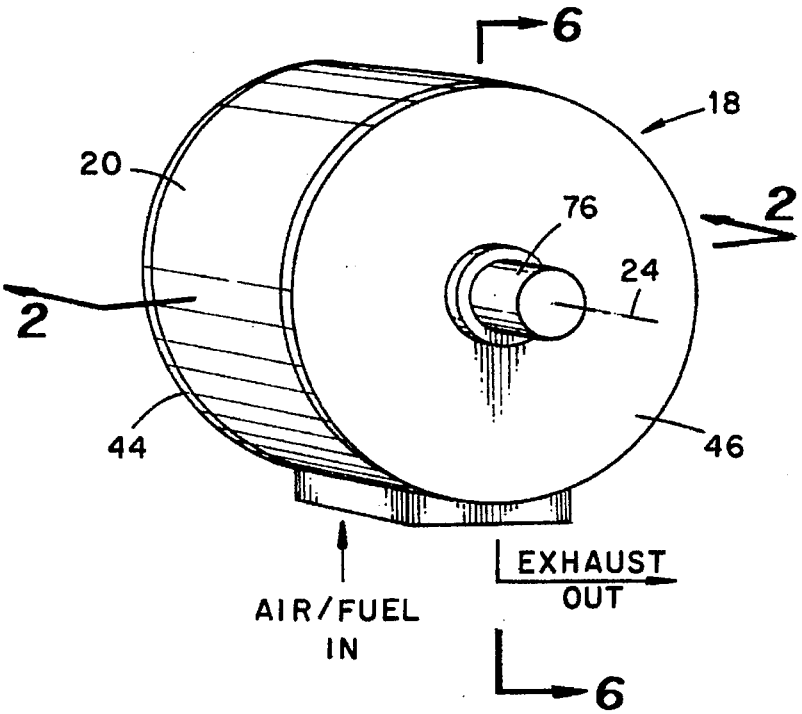
FIG. 1 is a perspective view of an internal combustion engine within which features of the present invention are embodied.
Figure 2:
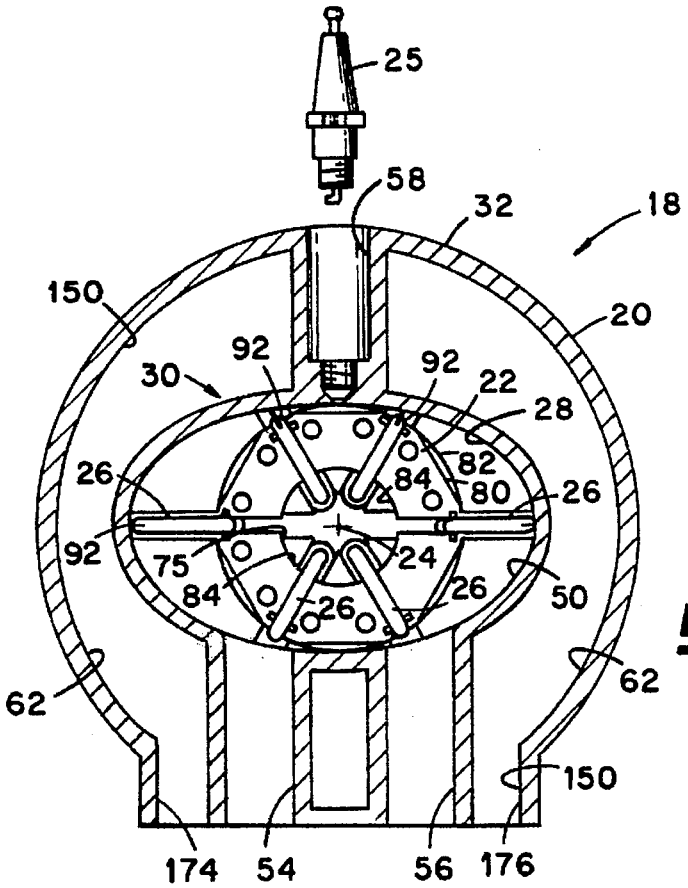
FIG. 2 is a cross-sectional view taken about along line 2—2 of FIG. 1.

Turning now to the drawings in greater detail, there is shown in FIGS. 1 and 2 a internal combustion engine, generally indicated 18, within which features of the present invention are embodied. The engine 18 is a guided vane-type rotary apparatus including means providing a housing 20, means providing a rotor 22 mounted within the housing 20 for rotation about an axis 24, a plurality of vanes 26 which, with the rotor 22 and housing 20 for dividing the interior, indicated 28, of the housing 20 into working chambers. In the depicted engine 18, the vanes 26 are slidably mounted within the rotor 22 for sliding movement relative thereto between alternative radial positions. The engine 18 also includes means, generally indicated 30 in FIG. 2, connected to the vanes 26 and acting upon the housing 20 for coordinating the radial movement of the vanes 26 as the rotor 22 is rotated about the axis 24. As will be described herein, the coordinating means 30 cooperates with the housing 20 to shift the vanes 26 toward and away from the axis 24 in conjunction with the rotation of the rotor 22 within the housing 20.

Although the embodiment 18 described herein is an internal combustion engine adapted to convert forces generated by the combustion of an air/fuel mixture to rotary motion (by way of an output shaft), the invention described herein is adaptable to other guided-vane rotary apparatus, such as pumps, compressors, and fluid operated motors. Accordingly, the principles of the invention can be variously applied.

Figure 3:
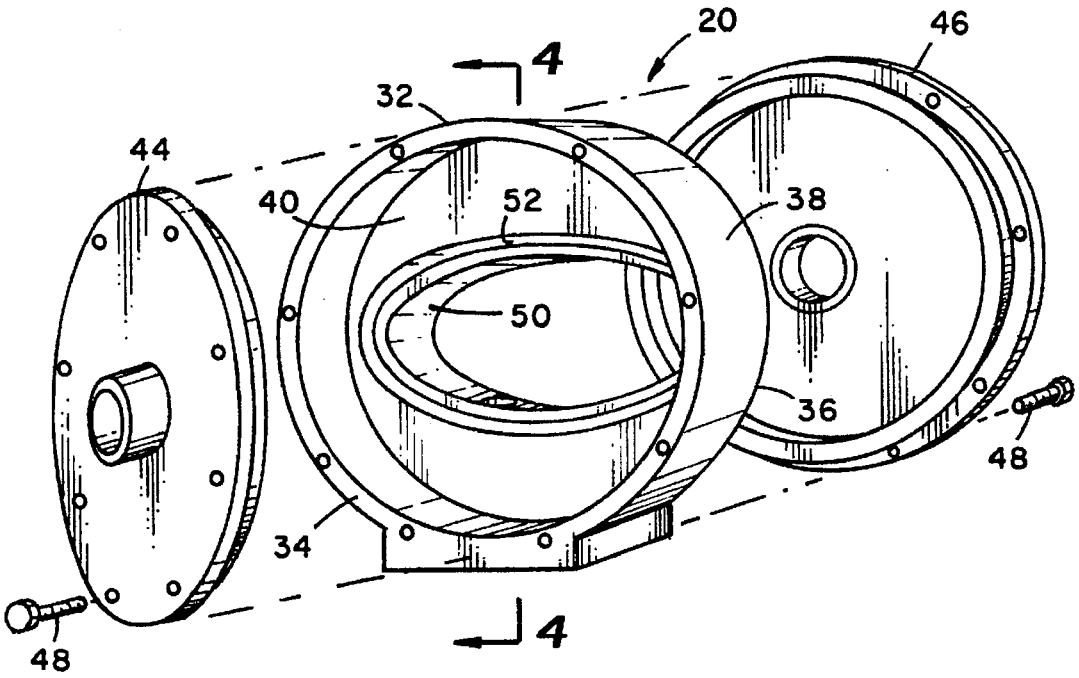
FIG. 3 is a perspective view of the housing of the FIG. 1 engine, shown exploded.
Figure 4:
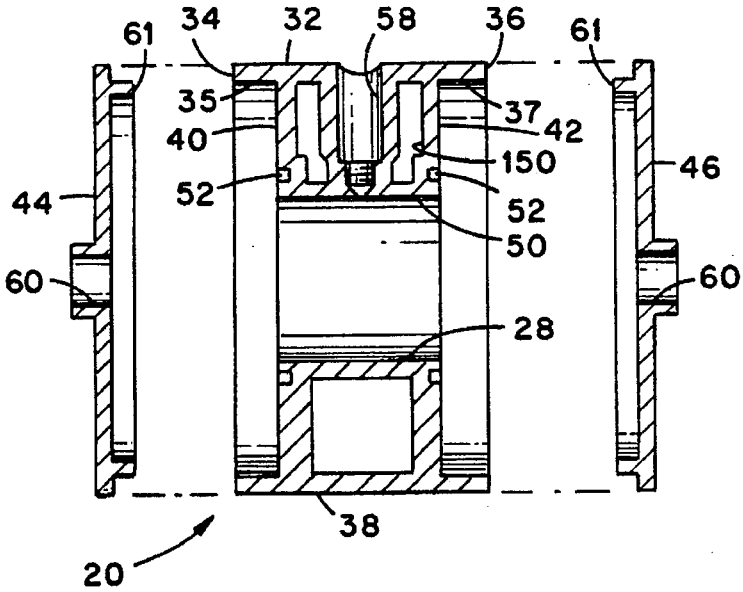
FIG. 4 is a view which illustrates schematically a longitudinal cross section of the housing of the FIG. 1 engine wherein the cross section is taken about along line 4—4 of FIG. 3.

As best shown in FIGS. 3 and 4, the housing 20 includes a central body 32 having two opposite sides 34, 36 and two end plates 44, 46 fixedly secured to the body sides 34, 36. The central body 32 includes an outer surface 38 having a major portion which is substantially cylindrical in shape, and there is defined within each side 34 or 36 a circular recess 35 or 37 having a bottom which provides a corresponding side face 40 or 42 of the body 32. The side faces 40, 42 are parallel to one another and each lies in a radial plane of the body 32. The pair of end plates 44, 46 are each generally platen-like in form, include a central through-opening 60, a peripheral flange 61 adapted to be received by a corresponding recess 35 or 37 and is secured to the sides 34, 36 of the body 32 with bolts 48 (only two shown in FIG. 3) so as to cover, yet are spaced from, the side faces 40, 42 of the housing body 32.

The central body 32 defines a through-opening 50 which extends between the two side faces 40, 42 and which is of elliptical cross section, as viewed in FIG. 2. As will be apparent herein, the walls of the opening 50 provide the side walls of the housing interior 28 within which the rotor 22 is positioned. Furthermore, each side face 40 or 42 defines a shallow groove 52 of substantially rectangular cross section and which encircles the mouth of the opening 50. The groove 52 is endless in that it is continuous about the opening 50 and follows a substantially elliptical, i.e. non-circular, path thereabout, and its purpose will be apparent herein.

With reference again to FIG. 2, the cycles of the internal combustion process of the engine 18 are carried out within the housing interior 28, and for purposes of providing ingress and egress of air/fuel and exhaust, respectively, from the housing interior 28, the central body 32 defines a working fluid inlet port 54 and an exhaust port 56. During engine operation, the inlet port 54 provides passage of the working fluid into the housing interior 28 and the exhaust port 56 permits passage of the products of combustion out of the housing interior 28. The body 32 of the depicted housing 20 also includes a recess 58 opening out of the cylindrical surface of the body 32 and communicating with the housing interior 28 for threadably accepting a spark plug 25 and further includes internal passages 62 through which a coolant can be routed.

Figure 5:
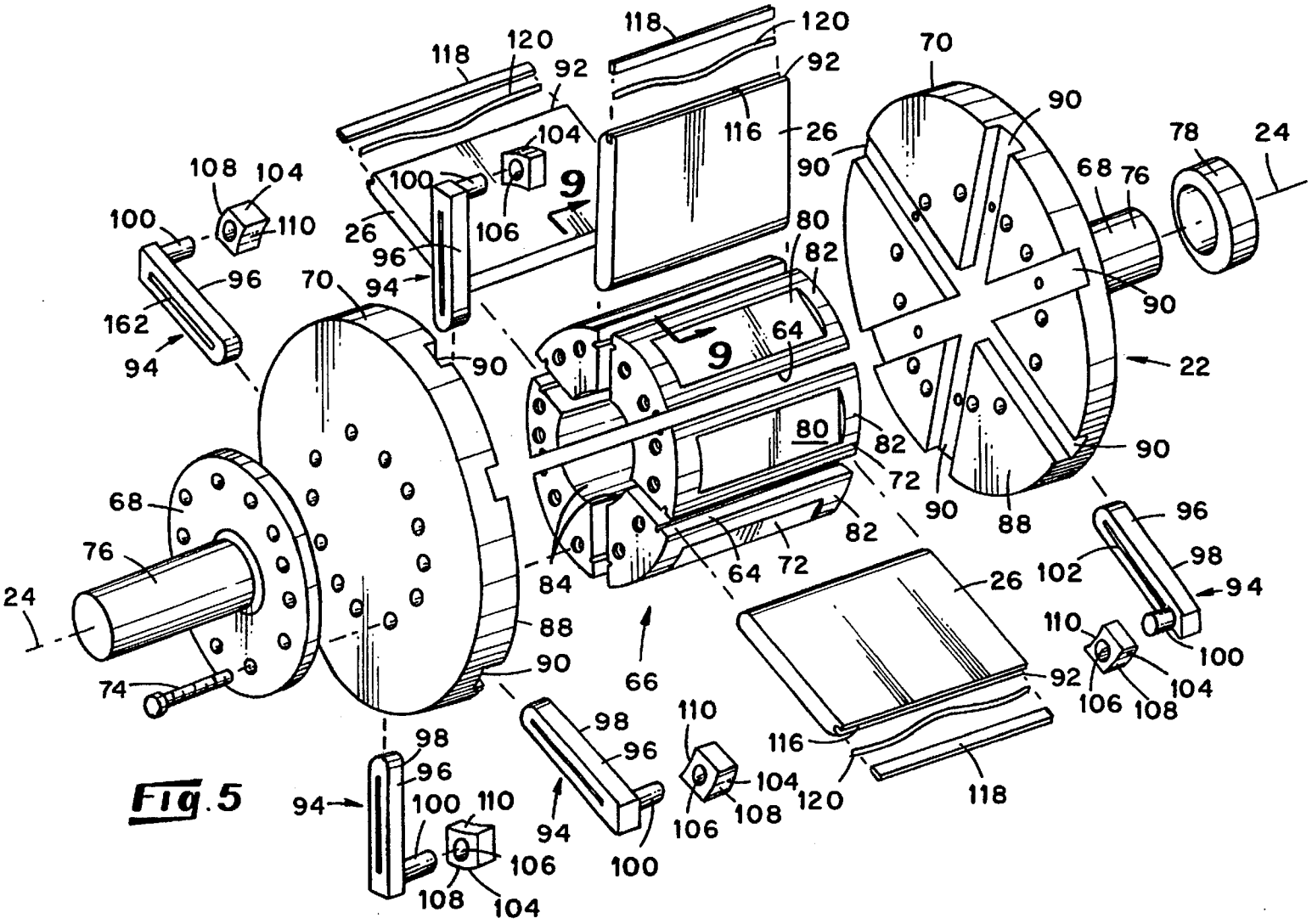
FIG. 5 is a perspective view of various components of the FIG. 1 engine, shown exploded.

With reference to FIG. 5, the rotor 22 includes a somewhat spool-shaped assembly 66 including a pair of shaft-bearing flanges 68 having a shaft 76, a pair of circular rotor disks 70, and a plurality of, i.e. six, central hub sectors 72. Each shaft flange 68 and disk 70 is fixedly joined, as with bolts 74, to a corresponding end of the sectors 72 so that these joined elements must rotate together as a single unit with no relative movement between these joined elements. When mounted within the housing 20, the center of mass of this unitary rotor assembly 66 is located along the rotation axis 24, and the shafts 76 extend through the central openings 60 (FIG. 4) of the housing end plates 44, 46. When extending through the end plate openings 60 in this manner, the shafts 76 support the rotor 22 for rotation about the axis 24, as well as transmit rotational forces from the rotor 22. An anti-friction bearing, such as a ball bearing 78 (only one shown in FIG. 5), is retainably positioned between the surfaces of the shaft 76 and the wall of the end plate opening 60 at each end of the engine 18 to facilitate the rotation of the rotor 22 relative to the housing 20.

With reference still to FIG. 5, each hub sector 72 is shaped to resemble a truncated sector of a right circular cylinder having an arcuate outwardly-directed surface 82 and an arcuate inwardly-directed surface 84. In addition, each sector 72 is attached at its ends to the rotor disks 70 so that each sector 72 is maintained in a spaced relationship with its adjacent sector 72. The spacing, indicated 64 in FIG. 5, provided between adjacent sectors 72 provides a slot within which a vane 26 is slidably positioned. The inwardly-directed surfaces 84 of the sectors 72 collectively form, with the surface of the rotor disks 70, a central space 75 (FIG. 2) adequate in size for preventing excessive pressures created by the combined alternating inward and outward movement of the vanes 26 during operation. The outwardly-directed surface 82 of each sector 72 is shaped to provide a relatively close operating proximity with the walls of the housing interior 28 as the sector 72 passes the spark plug-accepting recess 58 and the mouth of the exhaust port 56 provided on the opposite wall of the housing interior 28. In the depicted embodiment, the outwardly-directed surface 82 of each sector 72 is provided with a shallow flat 80 (which alternatively may be a formed radius or depression) to provide adequate space for combustion of the air/fuel mixture when the sector 72 is positioned adjacent the spark plug recess 58.

As best shown in FIG. 5, each rotor disk 70 includes an inner face 88 which is provided with a series of grooves 90 which extend radially across the disk face 88. In the depicted embodiment 18, there are six radially-extending grooves 90, and each groove 90 is aligned with (i.e. is in registry with) a corresponding space 64 provided between adjacent sectors 72. As will be apparent herein, these grooves 90 provide guide tracks along which the vanes 26 are guided as each vane 26 is shifted radially of the rotor 22 during rotor rotation.

With reference still to FIG. 5, each vane 26 (only three shown in FIG. 5) is generally platen-like in shape and generally rectangular in form. Each vane 26 is sized to be slidably accepted by a corresponding spacing 64 provided between each pair of adjacent sectors 72 and includes an outwardmost tip edge 92 which is rounded along its length. During rotation of the rotor 22 within the housing interior 28, the vane edge 92 is maintained in relatively close proximity with the walls of the housing opening 50, and the roundness of the edge 92 reduces the likelihood of rubbing interference with the housing walls.

With reference again to FIG. 2, the vanes 26, in conjunction with the surfaces 82 of the rotor sectors 72, divide the housing interior 28 into six working chambers. Due to the non-circular walls of the interior 28, the chambers vary in volume through a single revolution of the rotor 22 about the axis 24. It will be appreciated that as the rotor 22 is rotated relative to the housing 20 about the axis 24 in a clockwise direction, as viewed in FIG. 2, an air/fuel mixture, which enters the housing interior 28 through the inlet port 54 and is trapped within a chamber, is subsequently compressed as the vanes 26 (which are maintained in close proximity to the walls of the housing 28) are rotated by the rotor 22 toward the spark plug-receiving recess 58 where combustion occurs. As the chambers are rotated along the right side, as viewed in FIG. 2, the shape of the chambers accommodates the expansion and exhaust cycles of the engine operation.

For purposes of shifting the vanes 26 radially of the rotor 22 during engine operation so that the tip edges 92 thereof are maintained in relatively close proximity to the walls of the housing interior 28, the coordinating means 30 of the engine 18 includes a plurality of linkage assemblies 94 interposed between the vanes 26 and the grooves 52 (FIG. 4) provided in the side faces 40, 42 of the housing body 32. As best shown in FIG. 5, each linkage assembly 94 (only five shown in FIG. 5) includes an elongated linkage element 96 having a bar portion 98 and a transversely-extending pin 100 joined to so as to extend to one side of the bar portion 98. The side of the bar portion 98 corresponding with the pin 100 defines a linear groove 102 within which one side of a vane 26 is captured. Accordingly, the groove 102 is sized to closely accept an edge of a vane 26 when the vane edge is directed therein. Furthermore, each bar portion 98 is slidably received within a corresponding groove 90 defined along the disk face 88 to accommodate sliding movement longitudinally therealong, and the bar portions 98 are sized accordingly.

Figure 6:
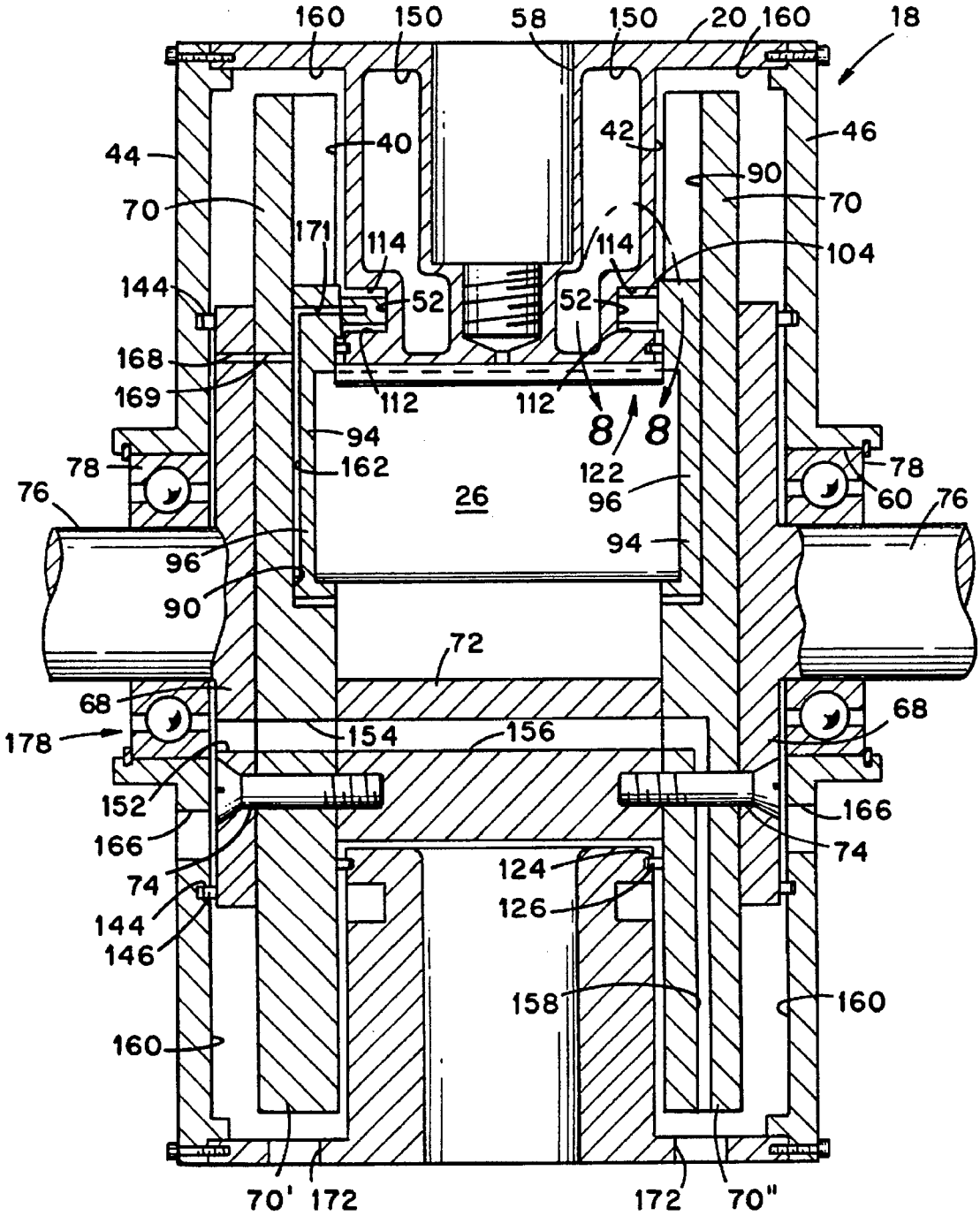
FIG. 6 is a cross-sectional view taken about along line 6—6 of FIG. 1.
Figure 7:
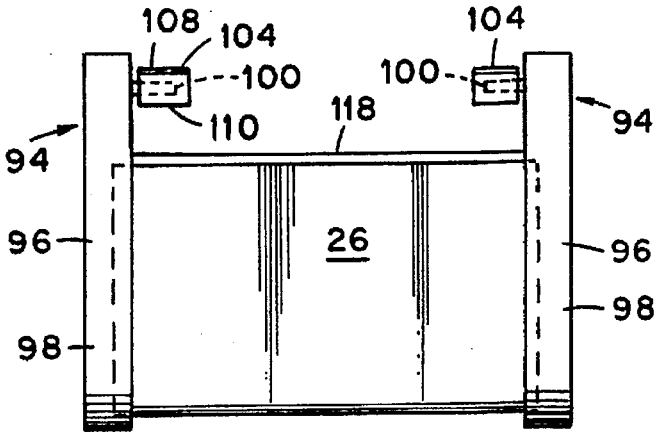
FIG. 7 is an elevational view of a vane of the FIG. 1 engine to which linkage assemblies are secured.

Each linkage assembly 94 also includes a camming, i.e. a cam follower, element 104 positioned about the pin 100 and which is received by the groove 52 provided in the side face 40 or 42 of the housing body 32. To this end, the depicted cam follower element 104 is somewhat block-shaped (and non-circular) in form so as to provide opposite outwardmost and inwardmost surfaces 108 and 110, respectively, and includes a central opening 106 through which the pin 100 is positioned. When the linkage assemblies 94 are assembled about a vane 26 (as shown in FIG. 7) and positioned within the housing 20 (as shown in FIG. 6), two bar portions 98 are positioned on opposite sides of each vane 26 and each of two cam follower elements 104 is positioned within a groove 52 provided in the side face 40 or 42. When each bar portion 98 is positioned within a corresponding groove 90 defined along the disk face 88, the vane 26 captured therein is provided with full end support and prevented from shifting relative to the bar portion 98 along the length of the groove 102. In other words, each vane 26 is supported by its corresponding pair of linkage assemblies alone and not by the surfaces of the hub sectors 72 disposed on opposite sides of the spacing 64 provided between adjacent hub sectors 72. Accordingly, as the rotor 22 is rotated about the axis 24 and the bar portions 98 are shifted longitudinally of the disk grooves 90 in the manner described herein, each vane 26 is forced to shift radially of the rotor 22 with the bar portions 98.

Figure 8:
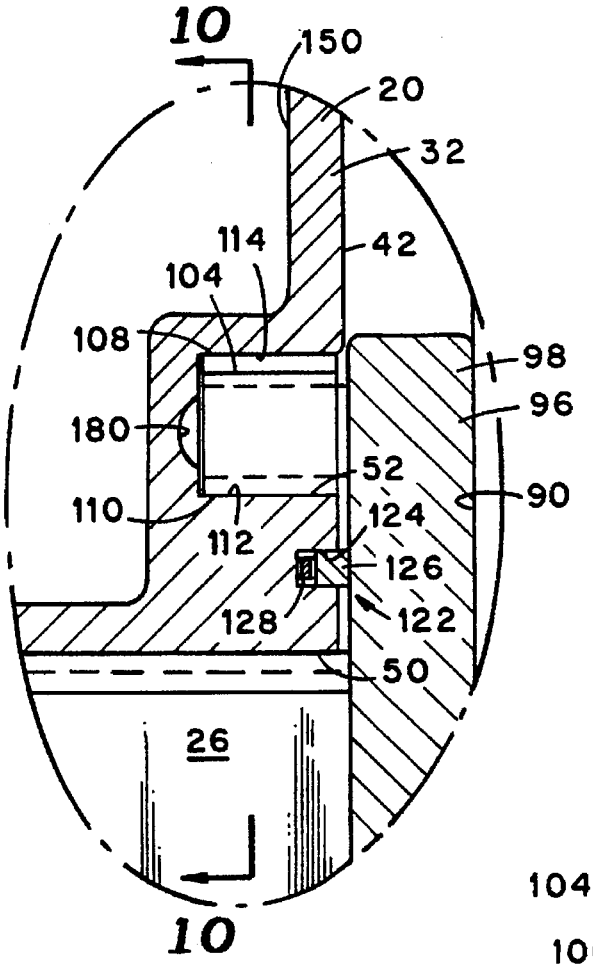
FIG. 8 is a portion of the FIG. 6 view taken about along line 8—8 of FIG. 6, drawn to a slightly larger scale.

As described earlier, the groove 52 provided in each side face 40 or 42 of the housing body 32 extends continuously about the body opening 50 in an unbroken loop. During rotation of the rotor 22 about the axis 24, each groove 52 provides a continuous closed track, i.e. a cam groove, in the corresponding side face 40 or 42 along which the cam follower elements 104 slidably move, and as shown in FIGS. 6 and 8, includes an inner wall 112 and an outer wall 114. To compensate for the curvature in the outer wall 114 of the groove 52, the outwardmost surface 108 (FIG. 5) of each cam follower element 104 is provided with a curvature which substantially matches the minimum radius of that of the outer groove wall 114. Similarly, to compensate for the curvature of the inner wall 112 of the groove 52, the inwardmost surface 110 of each cam follower element 104 is provided with a curvature which substantially matches the maximum radius of that of the inner groove wall 112. It follows that the outermost and innermost surfaces 108, 110 of the cam follower element 104 are formed to provide cooperative sliding engagement with the cam groove walls 114, 112, respectively, and thereby maintain precise radial alignment with the corresponding cam groove 52. It also follows that during rotation of the rotor 22 about the axis 24, the cam follower elements 104 are retained on the linkage assembly pins 100 by the walls of the grooves 52. Thus, the grooves 52, along with the associated cam follower elements 104, provide precise radial positioning control of the bar portions 98 of the linkage assemblies 94 relative to the housing 20, thereby providing precise radial positioning control of the vane 26 connected thereto.

It follows that as the rotor 22 is rotated about the axis 24, the vanes 26, which are captured within the rotor spaces 64, must rotate about the axis 24 as well. Because the slidable cam follower elements 104 of the linkage assemblies 94 are captured within the elliptical cam grooves 52 for sliding movement therealong and must consequently shift toward and away from the axis 24 during a single revolution of the rotor 22 about the axis 24 in accordance with the shape of the elliptical path of the groove 52, the vanes 26 must shift toward and away from the rotation axis 24 during a single revolution of the rotor 22 about the axis 24. It also follows the tip edges 92 of the vanes 26 are maintained in relatively close proximity to the walls of the housing interior 28 as the linkage assemblies 94 maintain a fixed spacing between the tip edges 92 and the grooves 52. Each vane 26 is sized so that when shifted to its radially outwardmost position during a revolution of the rotor 22, a portion of the vane 26 remains captured within the rotor spacing 64. Furthermore, the radially-inwardly-directed end of each linkage element 96 may be chamfered or rounded, as shown in FIG. 5, to reduce the likelihood of any interference with an adjacent linkage element 96 operating in the vicinity of the rotational axis 24.

If desired, the inner wall of each groove 52 may be provided with a small relief channel 180 (FIG. 8) for relieving pressure and providing an axially-extending conduit accommodating the flow of lubricating oil therethrough. Furthermore and with reference again to FIG. 5, it is preferred that the vane tip, or edge 92, is formed with a groove 116 which extends along the length thereof for receiving a strip seal 118. The strip seal 118 is, in turn, backed by a bias spring 120. When assembled within the housing 22, the bias spring 120 urges the vane strip seal 118 to be held, along its full length, in sliding and continuous sealing contact with the wall of the housing body opening 50. Furthermore, the grooves 52 provided in the side faces 40, 42 are formed with such a contour so as to maintain the radial position of the strip seal 118 relative to the vane edge groove 116 relatively constant, and thereby maintain a continuous seal between the vane edge 92 and the wall of the housing body opening 50 at any rotational position of the rotor 22 about the axis 24. Preferably, the vane tip strip seal 118 is formed so as to include a radius at its outwardmost edge.

The curvature of the elliptical path of each groove 52 provided in the side face 40 or 42 is slightly different than that of the mouth of the housing opening 50. More specifically, the contour of the path of each groove 52 takes into account the major and minor axis dimensions of the elliptical contour of the housing opening 50, the distance between the center of the path of the groove 52 to the mouth of the housing opening 50 (corresponding to the groove offset) at a point on the major or minor axis, and the radius dimension of the vane tip seal 118. The contour of each groove 52 can be determined with a computer (not shown) and the location of the groove 52 points, e.g. those defined along the center of the groove 52, can be expressed in terms of x and y coordinate points wherein the origin corresponds with the rotational axis 24.

As an alternative to the linkage element 96, a narrow linkage may be provided wherein the alternative linkage has a thickness which is substantially the same as that of the vane 26, but having tabs which cooperatively interlock with corresponding recesses provided within the side edges of the vane to cause the vane and linkage to move in a radial fashion as a unitary piece. In this case, the vane is supported by the disk groove walls, rather than the linkage element. The narrow linkage may be preferred over the aforedescribed linkage element 96 for use in machines of very small size, primarily by allowing the linkage radially inner ends to operate nearer the axis of rotation, with corresponding smaller rotor radius.

It will be understood that the bar portion 98 of each linkage element 96 is fully received by the corresponding groove 90 provided in the disk face 88 so that the surface of the bar portion 98 within which the groove 102 is defined is substantially coplanar with that of the disk face 88. In addition, the axial length of each rotor sector 72 is slightly greater than the width of the housing interior 28 (wherein the width of the housing interior 28 corresponds with the depth of the housing through-opening 50) so that there is provided a small axial running clearance between the disk faces 88 and the side faces 40, 42 of the housing body 32. This running clearance allows free rotation of the rotor 22 and accommodates freedom for thermal expansion without interference between the rotor disk faces 88 and the side faces 40, 42 of the housing body 32.

Preferably, a rotor sealing means, generally indicated 122 in FIG. 8, is provided within the engine 18 for sealing of the aforedescribed running clearance between the rotor disk faces 88 and the side faces 40, 42 of the housing body 32. To this end, each housing side face 40 or 42 is provided with a continuous rotor seal groove 124 located between the groove 52 and the mouth of the opening 50. In the depicted engine 18, this rotor sealing groove 124 holds a sealing element 126 and backing bias spring 128. Such a sealing element 126 is a mechanical face-type seal which provides and maintains continuous sealing engagement between the housing body 32 and the rotor disk face 88. The seal 126 provides continuous sealing between the seal periphery and the outward wall of the groove 124.

As mentioned earlier, each vane 26 carries at its outwardmost edge or tip 92 a strip seal 118 and bias spring 120 for sealing the spacing between the vane 26 and wall of the housing opening 28. Lubrication for this sealing arrangement may be provided by way of an oil passage which communicates between the vane tip groove 116 and the oil channel 162 provided along the bar portion 98 of the linkage assembly 94.

Figure 9:
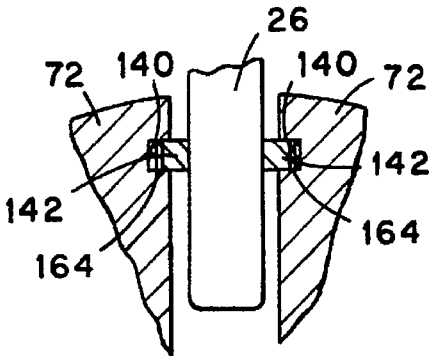
FIG. 9 is a fragmentary cross-sectional view taken about along line 9—9 of FIG. 5.

For purposes of sealing any spacing between each vane 26 and the hub sectors 72 between which the vane 26 is positioned and with reference to FIG. 9, each face of the sectors 72 which faces a side of the corresponding vane 26 is provided with a sealing groove 140 which extends along the length of the sector 72 and is situated adjacent the outer periphery of the sector 72. Within this groove 140 is positioned a vane face seal 142, i.e. a mechanical face-type strip seal, for sealing of the clearance between the opposing vane face and the sector face and for providing some degree of sealing at the bar portion 98 of the linkage assembly 94. This seal 142 is preferably backed by a bias spring 164 which provides and maintains continuous sealing engagement between the sealing groove 140 and the vane face. Lubricating oil may be routed to a seal 142 by way of an oil passage communicating between the sector seal groove 140 and the oil channel 162 provided along the bar portion 98 of the linkage assembly 94, or by admitting a small quantity of lubricating oil into the central space 75 (FIG. 2).

For purpose of sealing the oil supply and with reference again to FIG. 6, the inner face of each housing end plate 44 or 46 is formed to provide a circular groove 144 therein, and an oil seal 146 is located within this groove 144. Such a sealing element is a mechanical face-type seal which provides and maintains continuous sealing engagement between the inner face of the housing end plate and the outwardmost face of the shaft flange.

Figure 10:
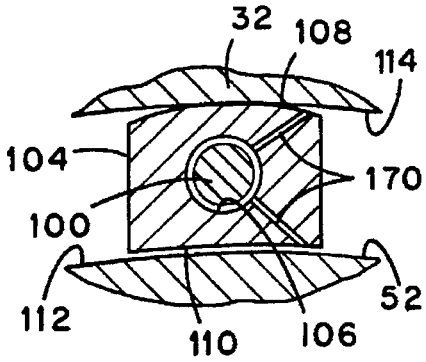
FIG. 10 is a fragmentary cross-sectional view taken about along line 10—10 of FIG. 8.

Lubrication and secondary cooling of the engine 18 is provided by a typical filtered recirculating pressurized lube oil supply system. Referring still to FIG. 6, lubrication oil enters the housing end plate 44 or 46 in a pressurized condition through an opening 166 formed therein and flows axially through the end plate 44 or 46 and into the space defined in part by the inner wall of the end plate 44 or 46. It follows that the shaft bearing 78 is lubricated, and cooled, in this manner. The lubrication oil subsequently flows through the shaft flange 68 by way of a path which routes oil to the linkage assembly 94 and the cam element 104 and a path which routes oil, for cooling purposes, to the rotor sectors 72 and disks 70. Along the first oil path, the oil passes through the oil passage 168 provided in the shaft flange 68, then through an oil hole 169 provided in the left disk 70 (indicated also 70') and into the disk groove 90. Oil situated in the disk groove 90 lubricates and cools the sliding bearing surfaces of the disk groove 90 and the bar portion 98 of the linkage assembly 94. The oil then passes into the oil channel 162 provided along the length of the bar portion 98, through the linkage pin oil passage 171, and then to the cam follower element 104 where it lubricates and cools the mating bearing surfaces of the cam follower element 104 and pin 100. In addition and as best shown in FIG. 10, the cam element 104 is provided with oil passages 170 for passage of oil therethrough to the outer bearing surfaces of the cam follower element 104.

It follows that the bearing surfaces of the cam element 104 and the walls of the groove 52 are thereby coated by a hydrodynamic fluid film. If desired, a small relief channel 180 (FIG. 8) may be provided in the inner wall of the groove 52 to prevent hydraulic locking between adjacent cam follower elements 104. The oil is subsequently expelled radially outwardly along the disk groove 90 and disk face 88 to the disk periphery where it is thrown into a scavenge space 160 (FIG. 6). The oil thereafter exits the scavenge space 160 through the oil return ports 172 and returns to the recirculating pressurized oil supply system. Additional oil removal from the groove 52 or relief channel 180 may be aided by a passage communicating between the groove 52 or relief channel 180 and oil return channels formed within the housing 20. In the case of a machine with a rotor shaft in a position other than horizontal, the cam groove disposed at the higher elevation is formed with at least one passage for routing excess oil from the cam groove to the oil return under the influence of gravity. A small passage (not shown but similar to the disk passage 158 shown in FIG. 6) may be provided in the disk 70 to relieve the central space 75 (FIG. 2) of any excess pressure or lubricating oil therein so that the pressure and oil may be subsequently expelled into the scavenge space 160.

Primary cooling, heat transfer, or temperature moderation of the engine 18 is provided by a typical pressurized recirculating liquid cooling system. As best shown in FIG. 2, the body 32 of the housing 20 is formed to include a cooling jacket space 150 between its outer wall and the wall of the opening 50. During engine operation, a liquid coolant enters the cooling jacket space 150 under pressure through a coolant inlet port 174 and flows throughout the space 150 absorbing heat from the surrounding wall surfaces before exiting the space 150 through a coolant outlet port 176. Alternatively, coolant may be caused to flow in a manner reverse of that shown, whereas coolant port 176 is the jacket inlet and the coolant port 174 is the outlet. The cooling jacket 150 may be formed to include at least one extended narrow heat exchange surface area or fin to aid in heat transfer at a location where greater heat transfer is desired. Such a fin may be formed to extend outward from the cooling jacket inner wall, or to extend inward from the jacket outer wall, or in combination, or may extend fully between the jacket inner and outer walls thereby bridging the two walls with a web for aided thermal transfer to or from the outside of the housing. Such a web will also provide additional strength to the housing structure. In the engine 18, a typical water based liquid is used as the engine coolant, but any suitable fluid medium can be used. In fact, air may be routed through the jacket space 150 as long as an adequate air mass flow is maintained. In an alternative embodiment, the housing structure may be formed to include a number of finned heat radiators located on the housing outer periphery, rather than an internal jacketed space, for cooling of the machine by air flowing over these fins.

In yet another alternative embodiment, both air and liquid can be utilized to provide primary cooling of the engine 18. In such a case, the housing 20 is formed with both an internal cooling jacket and a number of finned surfaces on the housing outer periphery whereby liquid can be passed through the jacket and air can be directed over the fins.

Secondary heat transfer or cooling may be provided by a second oil passage means, generally indicated 178 in FIG. 6, and is typically accomplished by the same fluid as the lubricating oil, but referred to herein as cooling oil to differentiate its function. The purpose of secondary cooling is to remove heat from internal components, moderate their temperature, and somewhat control thermal expansion among those components. Along the oil path provided by this oil passage means 178, the cooling oil passes axially through the shaft flange 68 by way of a cooling oil hole 152, through a cooling oil hole 154 provided in the disk 70', and then through a cooling oil passage 156 provided in the rotor sector 72. The rotor sector temperature is moderated or cooled as the cooling oil passes axially through the rotor sector cooling oil passage 156. The cooling oil then passes from the rotor sector 72 into a passage 158 formed in the opposite disk, indicated 70". The disk temperature is moderated or cooled as the cooling oil passes therethrough, and the movement of the cooling oil within the disk passage 158 is aided by centrifugal force generated by the rotation of the rotor 22. The cooling oil is subsequently expelled from the disk periphery into the scavenge space 160 where it exits through the oil return ports 172 and returns to the recirculating pressurized oil supply system (not shown). There may exist multiple cooling oil holes in each sector of the disks 70 and multiple corresponding cooling oil passages in each sector 72.

Since the engine 18 is an internal combustion heat engine, the (stator) housing 20 has at least one inlet or intake port, at least one outlet or exhaust port, a fuel admitting means, and an ignition means. When operating as a spark ignition engine, the machine includes a spark plug, or other means of electrical discharge, for igniting the air/fuel mixture, and when operating as a compression ignition engine, the machine includes a fuel injection means and adequate compression for the ignition of the air/fuel mixture. When operating as a combined spark and compression ignition, the machine includes both electrical and compression ignition means.

As either a compressor, pump, motor, or expander, the stator housing of the apparatus is formed with at least one working fluid inlet port, and at least one working fluid outlet port. In a preferred embodiment of a compressor, pump, motor, or expander, there are two inlet ports and two outlet ports. The sector periphery is formed as substantially part of a cylinder or an arc, in shape, having no flat or depression.

It will be understood that numerous modifications and substitutions can be had to the aforedescribed embodiments without departing from the spirit of the invention. For example, there exists several factors pertaining to the present invention that can be manipulated according to the specific functional objectives to be met, and these factors will greatly influence the operating characteristics and suitability of the machine to a particular purpose. Such factors include housing cavity shape, number of vanes or chambers, and placement and number of inlet and outlet port openings. Thus, it will be appreciated that the spirit, scope, and fundamental structure of the invention will not be diminished due to the choice of these and other factors for a particular use.

Furthermore, although the aforedescribed embodiment 18 has been shown and described as including cam follower elements 104 which are adapted to slidably move along the walls of the grooves 52 as the rotor is rotated, cam follower elements in accordance with the broader aspects of the invention may take the form of roller elements which are adapted to move in rolling engagement along the walls of the grooves as the rotor is rotated. In either case, however, the cam elements are captured between the walls of the groove so that both the radial inwardly-directed shift and the radial outwardly-directed shift of the corresponding vanes to which the cam elements are connected are effected by the cooperation between the walls of the grooves and the cam elements positioned therein. Accordingly, the embodiments described herein are intended for the purpose of illustration and not as limitation.

I claim:

1. A guided-vane type rotary apparatus comprising:

housing means including a body defining an opening which provides an interior for the housing means;

a rotor including a body mounted within the interior of the housing means for rotation about an axis and defining a slot extending radially of the rotation axis, the body of the housing means further defining a side face adjacent the opening of the interior of the housing means and the side face defines a cam groove which encircles the opening and wherein the cam groove includes a radially inwardly-directed camming wall and a radially outwardly-directed camming wall; and a vane positioned within the slot of the rotor body for movement radially thereof between alternative radial positions, and means cooperating between the vane and the radially inwardly-directed and radially outwardly-directed camming walls of the cam groove defined in the side face of the body of the housing means for coordinating the radial movement of the vane relative to the rotor with the rotation of the rotor about the axis, the cooperating means including a follower element which is captured between the radially inwardly-directed and radially outwardly-directed camming walls of the cam groove for movement therealong and is connected to the vane so that as the rotor is rotated about its axis through a complete revolution and the follower element is guided along the cam groove, the follower element is forcibly shifted radially toward and away from the axis of rotation and the vane is forcibly and positively moved radially inwardly and outwardly with respect to the rotor by a corresponding amount.

2. The apparatus as defined in claim 1 wherein the cooperating means includes a linkage element fixedly joined to the van, and the follower element is connected to the linkage element so that as the follower element is shifted radially toward and away from the rotation axis during a revolution of the rotor, the vane is forcibly shifted radially as aforesaid by the linkage element.

3. The apparatus as defined in claim 2 wherein the rotor means includes means defining a guide slot within which the linkage element is slidably positioned to accommodate a radial shift of the linkage element between alternative radial positions in conjunction with the radial shift of the follower element toward and away from the rotation axis.

4. The apparatus as defined in claim 2 wherein the vane has a side edge oriented along a path extending radially of the rotation axis, and the linkage element includes means which cooperates with the side edge for substantially preventing relative movement between the linkage element and the side edge of the vane along a radial path.

5. The apparatus as defined in claim 4 wherein the cam groove is a first groove and the linkage element includes a second groove within which the side edge of the vane is retainably received.

6. The apparatus as defined in claim 2 wherein the follower element is rotatably connected to the linkage element to accommodate rotation of the follower element relative to the linkage element between alternative angular positions during a revolution of the rotor about the rotation axis yet is shaped so as to be prevented from rolling along the walls of the groove as the follower element is guided therealong.

7. The apparatus as defined in claim 6 wherein the follower element includes arcuate surfaces which are adapted to slide along the outwardly-directed and inwardly-directed walls as the follower element is guided along the cam groove.

8. The apparatus as defined in claim 7 wherein the follower element includes an outwardmost arcuate surface which is adapted to slide along the inwardly-directed wall of the groove and an inwardmost arcuate surface which is adapted to slide along the outwardly-directed wall of the groove, and the outwardmost arcuate surface of the follower element has a radius of curvature which substantially matches the minimum radius of curvature of the inwardly-directed wall of the groove and the inwardmost arcuate surface of the follower element has a radius of curvature which substantially matches the maximum radius of curvature of the outwardly-directed wall of the groove.

9. The apparatus as defined in claim 2 wherein at least one of the linkage element and the follower element includes an opening through which a lubricating medium is permitted to flow.

10. The apparatus as defined in claim 1 wherein the opening of the housing body includes a mouth and the groove follows a path outboard of the mouth so that as the follower element is guided along the groove through a single revolution of the rotor, the vane is maintained in relative close proximity to the walls of the opening of the housing body.

11. The apparatus as defined in claim 1 wherein the side face of the body of the housing means is a first side face and the body of the housing means includes a second side face opposite the first side face and wherein the second side face defines a groove which encircles the opening, and the cooperating means includes two follower elements positioned within the grooves defined within the side faces of the body of the housing means and connected to a vane so that as the rotor is rotated about the rotation axis through a complete revolution, the surfaces of the grooves act as cams and the follower elements act as cam followers to shift the vane radially of the rotor as the follower elements are shifted radially toward and away from the axis of rotation.

12. The apparatus as defined in claim 11 wherein the vane includes two opposite side edges, and the cooperating means includes a linkage element attached to each side edge of the vane in a manner which prevents relative movement between the linkage elements and the vane along a path extending radially of the rotor, and each follower element is rotatably connected to a corresponding linkage element to accommodate rotation of the follower element relative to the linkage element between alternative angular positions during a revolution of the rotor about the rotation axis yet is shaped so as to be prevented from rolling along the walls of the groove as the follower element is guided therealong.

13. The apparatus as defined in claim 11 wherein the vane includes opposite side edges and the cooperating means includes linkage elements connected between each follower element and a corresponding side edge of the vane for preserving a fixed spacing between each follower element and the corresponding side edge of the vane so that as the follower elements are shifted toward and away from the rotation axis as the follower elements are guided along the grooves during a revolution of the rotor about the rotation axis, the vane is moved radially of the rotor in conjunction with the radial movement of the follower elements relative to the rotation axis.

14. A guided-vane type rotary apparatus comprising:

housing means including a) a body having two opposite, substantially planar side faces and an opening extending between the side faces, and at least one of the side faces defines a cam groove encircling the opening wherein the cam groove includes opposing radially inwardly-directed and radially outwardly-directed camming walls, and b) two face plates attached to a corresponding side face of the body of the housing means so as to cover the opening defined therein and so that the face plates and the walls of the opening of the body provide an interior for the housing means, and c) a rotor including a body mounted within the interior of the housing means for rotation about an axis and defining a plurality of slots wherein each slot extends between the side faces of the housing body and opens radially outwardly of the rotor body;

d) a plurality of vanes associated with the rotor wherein each vane is positioned within a corresponding slot defined within the body thereof for rotation with the rotor body about the rotation axis and for sliding movement relative to the rotor body between alternative radial positions and includes a radially outwardly-directed tip edge; and e) means cooperating between the vanes and the radially inwardly-directed and radially outwardly-directed camming walls of the cam groove defined in the one side face of the housing body of the housing means for coordinating the radial movement of the vanes relative to the rotor with the rotation of the rotor about the rotation axis so that during rotation of the rotor about the rotation axis, the tip edge of each vane is maintained in close proximity to the wall of the opening of the housing body, and the cooperating means includes a follower element associated with each vane and positioned between the radially inwardly-directed and radially outwardly-directed camming walls of the cam groove for movement therealong so that as the rotor is rotated about the rotation axis through a single revolution, the follower elements move along the cam groove and are forcibly shifted radially toward and away from the axis of rotation and so that the vanes are forcibly and positively moved radially toward and away from the rotation axis in conjunction with the rotation of the rotor about the rotation axis.

15. The apparatus as defined in claim 14 wherein the cooperating means includes a linkage element interposed between each follower element and a corresponding vane, and the follower element is connected to the linkage element so that as each follower element is shifted radially toward and away from the rotation axis during a revolution of the rotor, the corresponding vane is forcibly shifted radially as aforesaid.

16. The apparatus as defined in claim 15 wherein the rotor means includes means defining a plurality of guide slots within which the linkage elements are slidably positioned to accommodate a radial shift of the linkage element between alternative radial positions in conjunction with the radial shift of the follower element toward and away from the rotation axis.

17. The apparatus as defined in claim 14 wherein each follower element is rotatably connected to a corresponding linkage element to accommodate rotation of the follower element relative to the linkage element between alternative angular positions during a revolution of the rotor about the rotation axis yet is shaped so as to be prevented from rolling along the walls of the cam groove as the follower element is guided therealong.

18. The apparatus as defined in claim 17 wherein each follower element includes one arcuate surface which is adapted to slide along the outwardly-directed wall as the follower element is guided along the groove and another arcuate surface which is adapted to slide along the inwardly-directed wall as the follower element is guided along the cam groove.

19. The apparatus as defined in claim 18 wherein said one arcuate surface each follower element has a radius of curvature which substantially matches the minimum radius of curvature of the inwardly-directed wall of the groove and said another arcuate surface of each follower element has a radius of curvature which substantially matches the maximum radius of curvature of the outwardly-directed wall of the groove.

20. The apparatus as defined in claim 14 wherein each side face of the housing means includes a cam groove encircling the opening defined in the body of the housing means, and the cooperating means includes two follower elements positioned within the grooves defined within the side faces of the body of the housing means and connected to one of the vanes so that as the rotor is rotated about the rotation axis, the surfaces of the cam grooves act as cams and the two follower elements act as cam followers to guide the one vane radially of the rotor as the follower elements are shifted radially toward and away from the axis of rotation and as the follower elements are guided along the cam grooves.

21. The apparatus as defined in claim 20 wherein the one vane includes two opposite side edges, and the cooperating means includes a linkage element attached to each side edge of the one vane in a manner which prevents relative movement between the linkage elements and the one vane along a radial path, and each follower element is rotatably connected to a corresponding linkage element to accommodate rotation of the follower element relative to its corresponding linkage element between alternative angular positions during a revolution of the rotor about the rotation axis yet is shaped so as to be prevented from rolling along the walls of the corresponding cam groove as the follower element is guided therealong.

22. The apparatus as defined in claim 14 wherein each vane includes opposite side edges and the cooperating means includes linkage elements connected between each follower element and a corresponding side edge of a vane for preserving a substantially fixed spacing between each follower element and the corresponding side edge of the vane so that as the follower elements are shifted toward and away from the rotation axis as the follower elements are guided along the grooves during rotation of the rotor, the vane is moved radially of the rotor in conjunction with the radial movement of the follower elements.

23. The apparatus as defined in claim 14 wherein the apparatus is an internal combustion engine.

* * * * *